US011746496B2

(12) United States Patent
Cui et al.

(10) Patent No.: US 11,746,496 B2
(45) Date of Patent: Sep. 5, 2023

(54) PRECISE LIFTING METHOD AND LIFTING AND REINFORCING STRUCTURE FOR PLANT EQUIPMENT FOUNDATION

(71) Applicant: BEIJING HENGXIANG HONGYE FOUNDATION REINFORCEMENT TECHNOLOGY CO., LTD., Beijing (CN)

(72) Inventors: Xuedong Cui, Beijing (CN); Jiguang Wu, Beijing (CN); Tengyue Cui, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/582,003

(22) Filed: Jan. 24, 2022

(65) Prior Publication Data

US 2022/0145576 A1 May 12, 2022

Related U.S. Application Data

(63) Continuation of application No. PCT/CN2020/107608, filed on Aug. 7, 2020.

(30) Foreign Application Priority Data

Aug. 9, 2019 (CN) ..... 201910736651.X

(51) Int. Cl.
*E02D 35/00* (2006.01)
*E02D 3/12* (2006.01)
*E02D 27/44* (2006.01)

(52) U.S. Cl.
CPC ..... *E02D 35/005* (2013.01); *E02D 3/12* (2013.01); *E02D 27/44* (2013.01)

(58) Field of Classification Search
CPC ..... E02D 27/34; E02D 35/005
See application file for complete search history.

(56) References Cited

U.S. PATENT DOCUMENTS 11,453,992 B2 * 9/2022 Cui ..... E02D 27/12
2018/0363268 A1 * 12/2018 Asplin ..... E02D 35/005
(Continued)

FOREIGN PATENT DOCUMENTS

CN 101487274 A * 7/2009
CN 101487274 A 7/2009
(Continued)

OTHER PUBLICATIONS

International Search Report of PCT Patent Application No. PCT/CN2020/107608 dated Nov. 6, 2020.

*Primary Examiner* — Frederick L Lagman

(57) ABSTRACT

The present application relates to a precise lifting method and a lifting and reinforcing structure for a plant equipment foundation. The method includes the construction steps of: forming a curtain wall: drilling downwards at two sides of the plant equipment to form curtain holes and grouting the curtain holes, in which the grouting areas overlap each other to form two parallel curtain walls; forming a reinforcing body: drilling grouting holes inclining downwards, grouting the grouting holes to form the reinforcing body attached to a lower surface of a baseplate of the plant equipment foundation among a bottom of the baseplate and two curtain walls; and lifting: drilling lifting holes obliquely downwards to below the bottom of the reinforcing body and between two curtain walls; and conducting pressure grouting to the bottom of the lifting holes and then backward grouting upwards layer by layer.

9 Claims, 4 Drawing Sheets

(56) References Cited

U.S. PATENT DOCUMENTS

| | | | | |
|---|---|---|---|---|
| 2022/0098819 | A1* | 3/2022 | Cui | E02D 35/005 |
| 2022/0145575 | A1* | 5/2022 | Cui | E02D 19/18 |
| 2022/0145576 | A1* | 5/2022 | Cui | E02D 37/00 |
| 2022/0154420 | A1* | 5/2022 | Cui | E01D 22/00 |

FOREIGN PATENT DOCUMENTS

| | | | | | |
|---|---|---|---|---|---|
| CN | 107100215 | A | | 8/2017 | |
| CN | 107476360 | A | | 12/2017 | |
| CN | 108547336 | A | | 9/2018 | |
| CN | 108824478 | A | | 11/2018 | |
| CN | 108842840 | A | * | 11/2018 | E02D 3/12 |
| CN | 108842840 | A | | 11/2018 | |
| CN | 109056859 | A | * | 12/2018 | E02D 35/005 |
| CN | 112081153 | A | * | 12/2020 | E02D 3/12 |
| CN | 112081155 | A | * | 12/2020 | E02D 3/12 |
| CN | 110965595 | B | * | 6/2021 | E02D 15/02 |
| CN | 112942455 | A | * | 6/2021 | E02D 35/005 |
| CN | 113818500 | A | * | 12/2021 | |
| CN | 114032976 | A | * | 2/2022 | |
| KR | 101803336 | B1 | * | 12/2017 | |

* cited by examiner

PRECISE LIFTING METHOD AND LIFTING AND REINFORCING STRUCTURE FOR PLANT EQUIPMENT FOUNDATION

CROSS-REFERENCE TO RELATED APPLICATION

This application is a continuation of PCT application No. PCT/CN2020/107608 filed on Aug. 7, 2020, which claims the priority and benefits of Chinese patent application serial no. 201910736651.X, filed on Aug. 9, 2019. The entirety of the above-mentioned patent applications are hereby incorporated by reference herein and made a part of this specification.

TECHNICAL FIELD

The present application relates to a field of a construction lifting and in particular, relates to a precise lifting method and a lifting and reinforcing structure for plant equipment foundation.

BACKGROUND ART

At present, a construction of a plant is generally a frame structure, in which a foundation is an independent foundation, relying on columns and the independent foundation for bearing loads. In a conventional precision equipment plant, there is no equipment foundation in the plant and the equipment is directly disposed on a concrete baseplate in the thickness of 200 mm, with a soil layer of 1-9 m being backfilled under the ground. Due to an interspace between the concrete baseplate and the backfilling soil layer and a lack of the denseness of the backfilling soil layer, it fails to meet the design requirements of the foundation bearing capacity and leads to subsidence and deformation of the backfilling soil layer. As the foundation at the bottom of the equipment deforms, it further causes an ultralow machining accuracy. Therefore, how to precisely lift the plant equipment and reinforce the backfilling soil layer without negatively affecting the operation of the equipment is a problem to be solved.

The present application provides a method that can precisely lift and reinforce the plant equipment foundation and a lifting and reinforcing structure therefor.

SUMMARY

A first aspect of the present application is to provide a precise lifting method for plant equipment foundation by providing curtain walls on both sides of the plant equipment for isolation, and then providing a reinforcing body for lifting. The method has advantages of little disturbance to surroundings, controllability of the lifting height and high precision of lifting.

In the first aspect, a precise lifting method for plant equipment foundation includes following steps:

Step S1, forming a curtain wall: drilling downwards in a vertical direction at two to-be-lifted sides of the plant equipment to form curtain holes and grouting the curtain holes, in which the grouting areas overlap each other to form two parallel curtain walls for separation from non-lifting areas;

Step S2, forming a reinforcing body: drilling grouting holes inclining downwards along the outer contour of the plant equipment in a length direction of the curtain wall, in which the grouting holes are symmetrically provided at both sides of the plant equipment, grouting the grouting holes to form the reinforcing body attached to a lower surface of a baseplate of the plant equipment foundation among a bottom of the baseplate and two curtain walls, so as to form a substantially inverted U-shaped structure together with two curtain walls; and Step S3, lifting: drilling lifting holes obliquely downwards to below the bottom of the reinforcing body and between two curtain walls, in which the lifting holes on both sides of the plant equipment are inclined toward each other; and conducting pressure grouting to the bottom of the lifting holes and then backward grouting upwards layer by layer, by which a soil body is pressed to generate an upward lifting force as a slurry in the curtain walls is continuously increased and solidified, so as to lift the plant equipment to a set lifting height equably.

In the above technical solution, by forming curtain walls at both sides of the plant equipment firstly, the plant equipment lifting area can be separated from the non-lifting area, so as to avoid disturbance to surrounding stratum in subsequent grouting process. In addition, the grouting pressure can be intensively transferred into the lifting force for plant equipment during lifting and grouting, so as to reach the controllability of the lifting force and lifting height, meet the lifting precision requirement, and prevent a problem that the slurry diffuses out to the non-lifting area to cause the dispersion of the grouting pressure, difficult control of the plant equipment lifting force and low control precision of the lifting height;

then the reinforcing body is formed at the bottom of the baseplate, in which the reinforcing body reinforces the foundation bearing capacity at the bottom of the plant equipment, increases the integration of the foundation, and prevent a bulging phenomenon in local lifting area during the subsequent grouting and lifting process. In addition, the reinforcing body is arranged under the baseplate to increase the thickness of the foundation, playing a buffering role in the subsequent grouting lifting and preventing a problem that the lifting velocity and the height of the plant equipment are difficult to control during lifting process due to too thin baseplate. This further increases the lifting precision. The present application has the advantages of little disturbance to surroundings, controllability of the lifting height and high precision of lifting.

Further, a plurality of rebars are provided between every two grouting holes in step S2. The rebars are inserted obliquely into the reinforcing body and form a structure similar to the reinforced concrete together with the reinforcing body, in which the rebars at both sides of the plant equipment are inclined toward each other.

In the above technical solution, rebars are inserted and then grouting is performed to form the reinforcing body, in which the rebars and the reinforcing body form a structure similar to reinforced concrete. This further increases the integrity of the reinforcing body, prevents the bulging phenomenon during lifting baseplate, and increases the precision of the lifting height. In addition, inserting rebars can reduce the thickness of the reinforcing body and correspondingly reduce the height of the curtain wall to save grouting material.

Further, based on the set lifting height in step S3, the lifting height is monitored in real time by precision leveling instrument.

In the above technical solution, the lifting height of each testing point can be obtained accurately in time to facilitate adjusting the corresponding grouting velocity and lifting velocity, so as to control the plant equipment lifting equably and ensure the stability during lifting the plant equipment.

Further, the depth of the curtain wall in step S1 is at least equivalent to a thickness of the backfilling soil layer.

In the above technical solution, the backfilling soil layer has a low compactness and has a high porosity therein. The curtain wall is provided to be deep enough at least to cover the backfilling soil layer, which can effectively prevent the slurry diffusion during subsequent grouting and lifting process. It can not only prevent causing disturbance to surrounding stratum when grouting, but also intensively transfer the grouting pressure into the lifting force, so as to reach the precise control of the lifting velocity and lifting height.

Further, the distance between adjacent curtain holes in step S1 is 2-3 m.

In the above technical solution, appropriate interval between the curtain holes is selected according to the diffusion radius of the slurry, so that the curtain walls that are covered by the adjacent curtain holes may overlap with each other for reducing slurry waste and cost.

Further, a distance between the curtain hole and the plant equipment in step S1 is 1-2 m.

In the above technical solution, on one hand, a certain space is leaved for grouting holes and lifting holes, on the other hand the disturbance to the plant equipment foundation is reduced when grouting curtain walls.

Further, a distance between the adjacent grouting holes in step S2 is 2-3 m.

In the above technical solution, appropriate interval of the curtain holes is selected according to the diffusion radius of the slurry, so that the curtain walls that are covered by the adjacent curtain holes may overlap each other for reducing waste of the slurry and cost.

Further, a drilling and grouting integrated backward grouting is performed in step S1, including lifting and grouting for a depth and repeating the lifting and grouting.

In the above technical solution, first drilling the grouting holes to the design depth, then grouting for a depth and lifting the grouting pipe upwards for the depth, which can further reduce the disturbance to the foundation soil layer. In addition, the drilling stem is easy to pull out after grouting, which facilitates the construction.

Further, a plurality of curtain holes are drilled around the plant equipment in step S1 and grouted in such a way that the grouting areas overlap with each other to form a closed curtain wall.

In the above technical solution, when the plant equipment is not strip shaped, the curtain walls form a closed space, and grouting in the curtain wall to lift the plant equipment, which is easier to control the lifting velocity, so as to realize precise lifting.

Further, a slurry for grouting the grouting holes to form the reinforcing body is solidified in 30-60 s, and a pressure slurry for lifting is solidified in 10-30 s.

In the above technical solution, the rapidly solidified slurry can quickly reinforce the soil layer and form the reinforcing body to prevent accelerated subsidence of the plant equipment due to softening of soil body under or around the plant equipment by the grouting slurry. The rapidly solidified slurry can avoid that slurry diffuses in large area during lifting to cause the waste of the material and reduce of the lifting force.

A second aspect of the present application is to provide a precise lifting and reinforcing structure for a plant equipment foundation by providing curtain walls on both sides of the plant equipment for separation, and then providing a reinforcing body for lifting, which has advantages of little disturbance to surroundings, controllability of the lifting height and high precision of lifting.

In summary, the present application can achieve the following beneficial technical effects.

1. Conducting lifting by providing the curtain walls and the reinforcing body can reduce the disturbance to the surrounding soil layer during grouting and can intensively transfer the grouting pressure into the lifting force to lift the plant equipment. This increases the controllability and precision of the plant equipment during lifting, and the reinforcing body can increase the integration of the bottom of the plant equipment, prevent a bulging phenomenon during lifting and have the advantages of little disturbance to surroundings, controllability of the lifting height and high precision of lifting.
2. The integrity of the reinforcing body can be further increased by providing rebars, which prevents the bulging phenomenon of local area during grouting and increases the precision of lifting.

DETAILED DESCRIPTION

The application is further described in detail below in combination with Figures.

Figure 1:
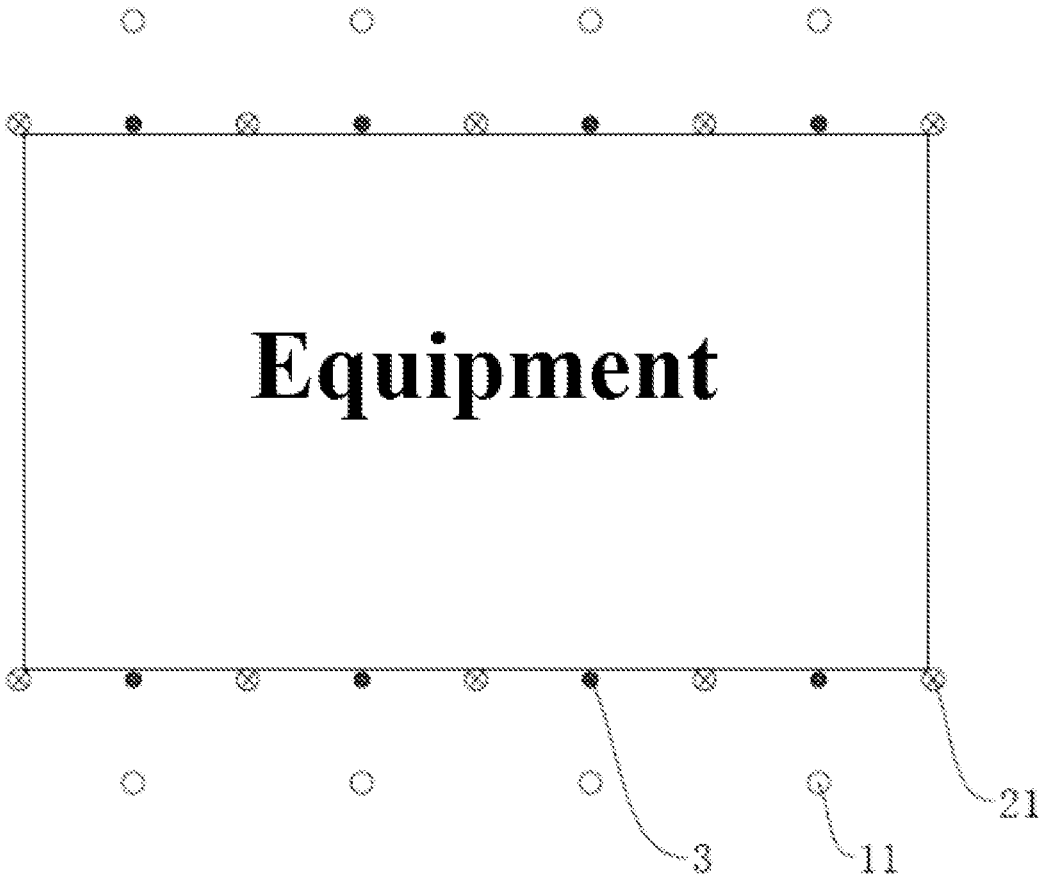
FIG. 1 is a top view of the present application.
Figure 2:
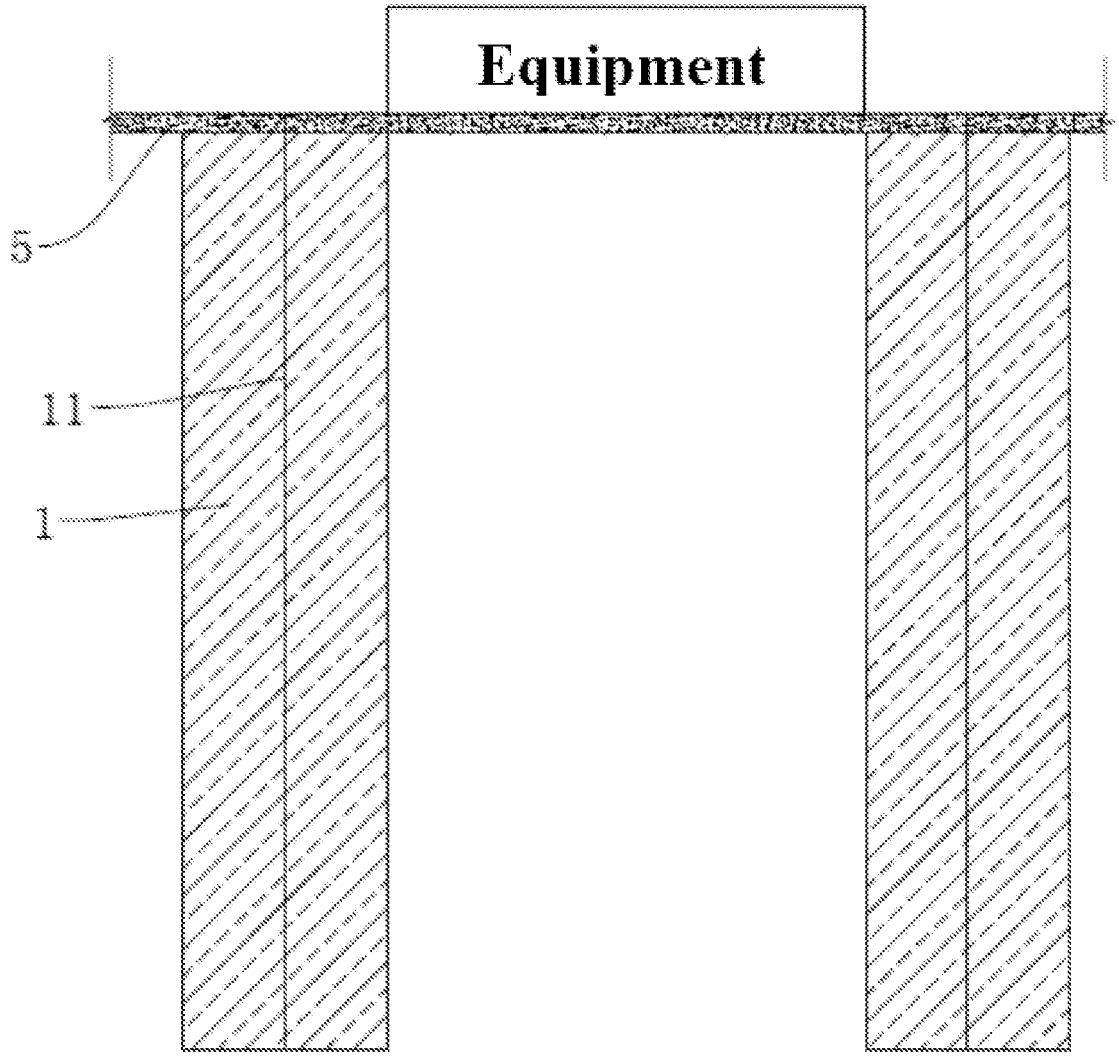
FIG. 2 is a section view of highlighted curtain wall of the present application.

The present application provides a precise lifting method for plant equipment foundation. A strip shaped plant equipment is taken as an example in the following for explaining, and the plant equipment is hereinafter referred to as equipment. The precise lifting method includes following steps:

Step S1, forming a curtain wall 1: referring to FIG. 1 and FIG. 2, curtain holes 11 are drilled downwards in the vertical direction at both sides of the equipment section needed to be lifted, in which the diameter of the curtain hole is 42 mm. A plurality curtain holes 11 are provided evenly spacing along the length direction of the equipment, in which the distance between the adjacent curtain holes 11 is 2-3 m and the distance between the curtain hole 11 and the equipment is 1-2 m. Grout is filled into the curtain holes 11, in which the grouting areas overlapped each other, so as to form two parallel curtain walls 1, the height of which may be equal to the thickness of the backfilling soil layer. The curtain wall 1 separates the lifting area of the equipment from the non-lifting area, which can prevent causing disturbance to surrounding backfilling soil layer during subsequent equipment lifting which otherwise would lifts the surrounding equipment. In addition, the curtain wall 1 separates the lifting area from the non-lifting area, which can bring no influence to the surrounding equipment and lift the subsiding equipment. Specifically, in the condition of causing no influence to the operation of the equipment, a row of curtain holes 11 are provided at 1 m distance from an outer edge of the equipment, in which the distance of the adjacent curtain holes 11 is 2 m. Holes are drilled downwards in the vertical direction and then grout is filled into the curtain holes 11 to form the curtain wall 1 with a height of 9 m. During construction, a drilling and grouting integrated backward grouting technology is adopted, that is, drilling the curtain holes 11 to the design deepness, lifting and then grouting for a length of 0.3-0.5 m, and repeating the lifting and grouting. In this way, the formed curtain wall 1 has a better integrity and it is easy to pull out the drilling stem after the grouting. The grouting pressure inside the curtain hole 11 is determined according to the design thickness and stratum.

Figure 3:
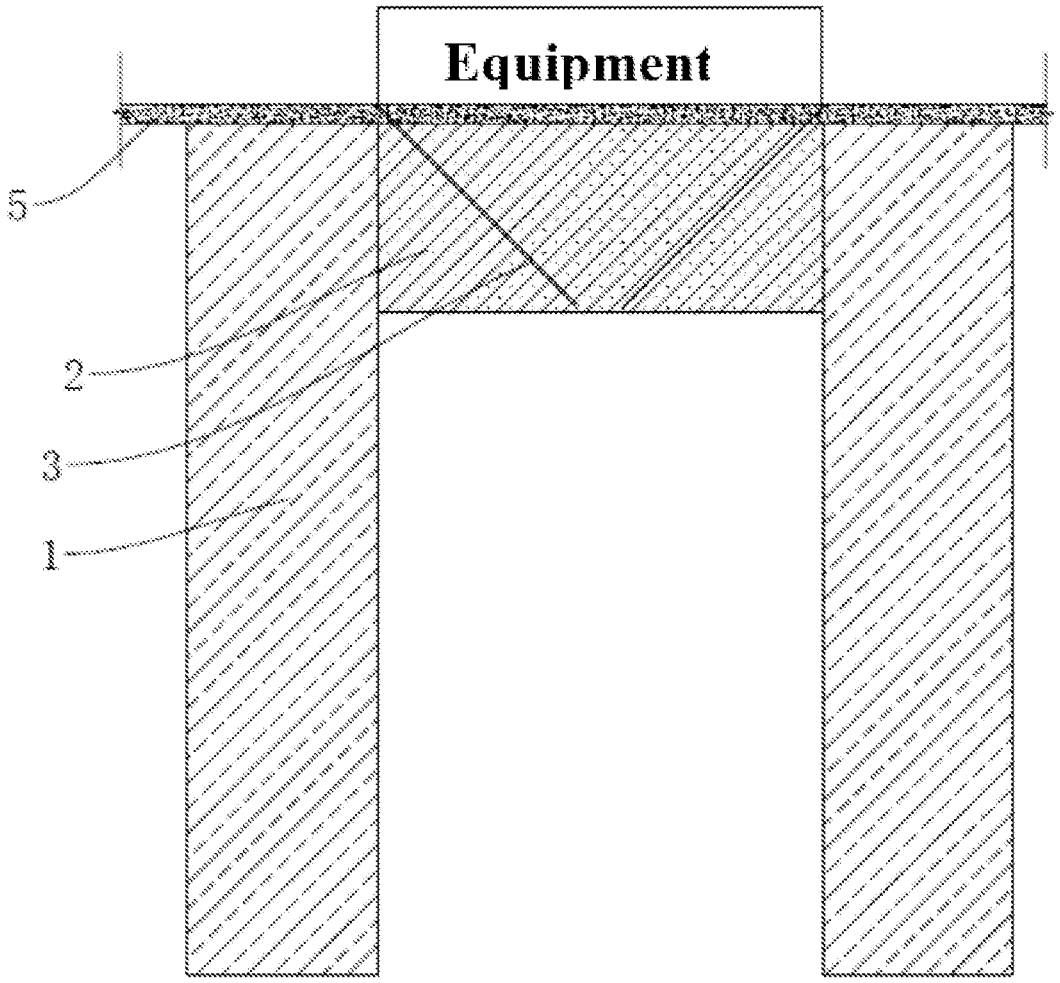
FIG. 3 is a section view of highlighted reinforcing body of the present application.

Step S2, forming reinforcing body: referring to FIG. 3, grouting holes 21 inclining downwards are drilled at the outer contour of the equipment along the length direction of the curtain wall, in which the diameter of the grouting hole is 42 mm, and the distance between the adjacent grouting holes is 2-3 m. Preferably, the grouting holes 21 is symmetrically provided at two sides of the equipment along the center line of the equipment in length and each pair of the grouting holes 21 are inclined toward each other. The grouting holes 21 are grouted, so as to form the reinforcing body 2 attached to the lower surface of a baseplate 5 of the equipment foundation among the bottom of the equipment foundation baseplate 5 and two curtain walls 1, in which the reinforcing body 2 and two curtain walls are interconnected as an inverted U-shaped structure. The reinforcing body 2 is formed under the baseplate 5 to reinforce the equipment foundation, which can increase the bearing capacity and integrity of the foundation under the equipment and prevent a bulging phenomenon during subsequent grouting and lifting. Further, it can be arranged under the baseplate 5 to increase the thickness of the foundation, playing a buffering role in the subsequent grouting and lifting to prevent a problem of difficult control of the lifting velocity and height of the equipment due to too thin baseplate 5. Specifically, after finishing grouting in curtain wall 1, grouting holes 21 are drilled along the length direction of the curtain wall 1 close to the outer contour of the equipment. The holes are inclined at an angle of 45°, 2 m from each other, and has a depth of 3 m. Grout is injected into the holes, so as to densify the backfilling soil to form the reinforcing body 2 making use of permeability of the slurry.

Further, in order to prevent the bulging phenomenon at local area during grouting and lifting, a plurality of rebars 3 are provided between adjacent grouting holes 21, in which the tilt direction of the rebar 3 is in line with that of the grouting hole 21. The rebar 3 is obliquely inserted into the reinforcing body 2 and forms a reinforced concrete together with the reinforcing body 2. Specifically, the rebar 3 is provided in the middle of adjacent grouting holes 21, and is inserted into the reinforcing body 2 in an inclining angle of 45°, in which the inserted length in the reinforcing body 2 is 3 m. Then the grouting holes 21 is grouted to integrate the rebar 3 with reinforcing body 2 to increase the integrity of the reinforcing body 2, so that the equipment can be lifted equably and prevent the bulging phenomenon in local lifting area during lifting. In addition, inserting rebars 3 can reduce the thickness of the reinforcing body 2 and in turn reduce the height of the curtain wall 1 to save grouting material.

Figure 4:
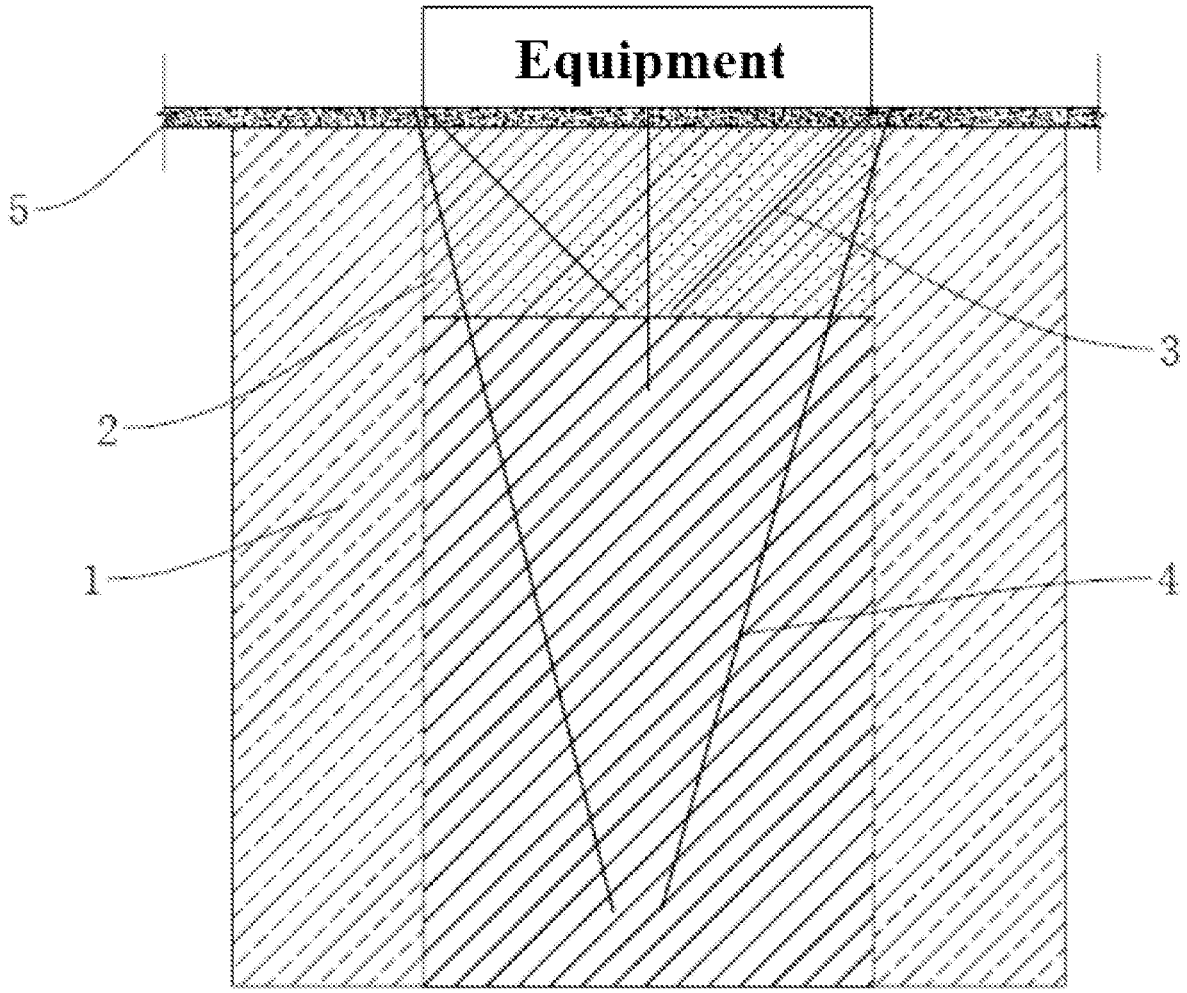
FIG. 4 is an overall section view of the present application.

Step S3, lifting: referring to FIG. 4, by using the grouting holes 21 as lifting holes 4, after the reinforcing body 2 is initially solidified, the lifting holes 4 are further drilled obliquely downward to be below the reinforcing body 2 and between two curtain walls 1. The lifting holes 4 on both sides of the equipment are inclined toward each other, and the bottom of the lifting hole 4 is at a position near the height of the bottom of the curtain wall 1. A pressure grouting is conducted in the lower portion of the lifting holes 4 to fill and reinforce the surrounding backfilling layer. Then a backward grouting is performed, in which grouting is conducted upwards layer by layer, with a backward layer distance of 10 cm-30 cm. As the slurry in the curtain walls 1 is continuously increased and solidified, the soil body is pressed to generate an upward lifting force, so that the plant equipment can be lifted to a set lifting height equably. Specifically, lifting and grouting are performed in lifting holes 4 in the area with large subsidence, and then lifting and grouting are performed in the area with small subsidence, so as to achieve a gradual levelling. The principle of setting the grouting pressure during lifting is: reference pressure=the total weight of the equipment and equipment foundation structure/bottom area of the foundation, in which the grouting pressure should be larger than a base pressure and smaller than 1.8 times of the base pressure. In step S2, the grouting pressure for reinforcing body 2 should be smaller or equal to the base pressure.

During the lifting process, in order to ensure the lifting height in each position and monitor the lifting velocity in each position, testing points are arranged at equal distance along the outer contour of the equipment. The heights at each testing points are monitored in real time using precise leveling instrument based on on-site reference elevation, so as to, monitor the lifting height at each testing point accurately and timely for facilitating adjusting the corresponding grouting velocity and lifting velocity.

The above description is made using a strip shaped equipment as an example. When the equipment is not regular square or rectangle, a plurality of curtain holes 11 are drilled along the circumference of the equipment, and grouted in such a way that the grouting areas overlap with each other to form a closed curtain wall 1. A reinforcing body 2 in formed in the closed structure of the curtain wall 1, and grouting for lifting is performed therein. This can effectively prevent the diffusion of the grouting slurry, so as to control the lifting velocity more easily and further realize the precise lifting.

In order to avoid an accelerated subsidence of the equipment during the whole construction process due to softening of the soil body under and around the equipment. All the slurries used for grouting are of quickly solidified type. Preferably, the grouting slurry forming the reinforcing body 2 is solidified in 30-60 s after being ejected from the nozzle of the grouting pipe, and the pressure slurry for lifting is solidified in 10-30 s after being ejected from the nozzle of the grouting pipe. The slurry used for grouting can be single slurry or double slurries.

Preferably, the above-mentioned slurry used to form the reinforcing body 2 and the pressure slurry used for lifting are two-component composite slurry. For convenience of description, it is named as slurry A and slurry B. Two slurries reach the slurry outlet of the grouting pipe from different channels, and are injected into the soil body around the slurry outlet, by which chemical reaction occurs to cause initial solidification in a short time.

The slurries for grout can be any one of existing slurries, as long as they can meet the requirements for initial solidification time and has good permeability.

Following is a formula of a grouting slurry which can be used with the present application: slurry A includes the following raw materials by weight parts: 70-90 parts of metallic oxide and/or metal hydroxide, 0.5-1.2 parts of composite retarder, 0.5-0.7 part of water reducer, 0.7-1.5 parts of acid-base buffer, 3-5 parts of composite stabilizer and 0.5-1.5 parts of composite surfactant. In particular, the metal oxide can be a combination of any two of magnesium oxide, alumina and magnesium phosphate. The composite retarder is urea and sodium tripolyphosphate. The water reducing agent is polycarboxylic acid water reducer. The acid-base buffer is magnesium carbonate or potassium hydroxide. The composite stabilizer includes at least two of hydroxymethyl cellulose, N-alkyl cetyl alcohol, starch ether and cellulose ether. The composite surfactant is at least two of alkyl polyoxyethylene ether, benzylphenol polyoxyethylene ether and alkyl sulfonate. When two or more different materials are used in the above individual components, they can be added by equivalent amount. Providing two materials are mainly to prevent the failure of one of them, so as to make the effect of the whole composite slurry more stable.

Slurry B includes the following raw materials by weight parts: 30~40 parts of phosphate and 0.2~1 part of defoamer. In particular, the phosphate can be diammonium hydrogen phosphate or potassium dihydrogen phosphate; and the defoamer can be silicone defoamer or polyether defoamer.

Slurry A and slurry B are mixed with water by a weight ratio of 100:(40-50) to form slurries respectively, injected into grouting pipe through different pipelines, combined with each other at the slurry outlet and solidified in the soil body.

Different initial solidification times of the composite slurry are realized by adjusting proportion of the composite retarder. Preferably, during pressure grouting in lifting process, less water should be added, so as to increase the concentration of grouting slurry to press the surrounding soil body better (for example, the weight ratios of slurry A to water and slurry B to water are 100:40). For other slurries for grouting, more water should be added and the concentration of grouting slurry is small (for example, the weight ratios of slurry A to water and slurry B to water are 100:50).

The above are the preferred embodiments of the present application, which are not intend to limit the protection scope of the present application. Therefore, all equivalent changes made according to the structure, shape and principle of the present application should be covered within the protection scope of the present application.

What is claimed is:

1. A precise lifting method for a plant equipment foundation, comprising the following steps:

Step S1, forming a curtain wall: drilling downwards in a vertical direction at two to-be-lifted sides of the plant equipment to form a plurality of curtain holes and grouting the curtain holes, wherein grouting areas overlap each other to form two parallel curtain walls for separation from non-lifting areas, a depth of the curtain walls is at least equivalent to a thickness of backfilling soil layer;

Step S2, forming a reinforcing body: drilling grouting holes inclining downwards along an outer contour of the plant equipment in a length direction of the curtain wall, wherein the grouting holes are symmetrically provided at both sides of the plant equipment; grouting the grouting holes to form the reinforcing body attached to a lower surface of a baseplate of the plant equipment foundation among a bottom of the baseplate and two curtain walls, so as to form a substantially inverted U-shaped structure together with two curtain walls, a plurality of rebars are provided between every two grouting holes, and the rebars are inserted obliquely into the reinforcing body and form a structure similar to reinforced concrete together with the reinforcing body, wherein the rebars at both sides of the plant equipment are inclined toward each other; and Step S3, lifting: drilling lifting holes obliquely downwards to below a bottom of the reinforcing body and between two curtain wall, wherein the lifting holes on both sides of the plant equipment are inclined toward each other; and conducting pressure grouting to the bottom of the lifting holes and then a backward grouting upwards layer by layer, whereby a soil body is pressed to generate an upward lifting force as a slurry in the curtain walls is continuously increased and solidified, so as to lift the plant equipment to a set lifting height equably.

2. The precise lifting method for a plant equipment foundation according to claim 1, wherein the lifting height is monitored in real time by a precision leveling instrument based on the set lifting height in step S3.

3. The precise lifting method for a plant equipment foundation according to claim 1, wherein a distance between adjacent curtain holes in step S1 is 2-3 m.

4. The precise lifting method for a plant equipment foundation according to claim 1, wherein a distance between the curtain hole and the plant equipment in step S1 is 1-2 m.

5. The precise lifting method for a plant equipment foundation according to claim 1, wherein a distance between adjacent grouting holes in step S2 is 2-3 m.

6. The precise lifting method for a plant equipment foundation according to claim 1, wherein the grouting is a drilling and grouting integrated backward grouting in step S1, comprising lifting and grouting for a depth and repeating the lifting and grouting.

7. The precise lifting method for a plant equipment foundation according to claim 1, wherein a plurality of curtain holes are drilled around the plant equipment in step S1 and grouted in such a way that the grouting areas overlap with each other to form a closed curtain wall.

8. The precise lifting method for a plant equipment foundation according to claim 1, wherein a slurry for grouting the grouting holes to form the reinforcing body is solidified in 30-60 s and a pressure slurry for lifting is solidified in 10-30 s.

9. A precise lifting and reinforcing structure for a plant equipment foundation, wherein the precise lifting and reinforcing structure is a lifting and reinforcing structure constructed by the precise lifting method for a plant equipment foundation according to claim 1.

* * * * *